US008153219B2

(12) United States Patent
Hooft

(10) Patent No.: US 8,153,219 B2
(45) Date of Patent: Apr. 10, 2012

(54) TAPE AND METHOD OF A MANUFACTURING THE SAME

(75) Inventor: Johannes Wilhelmus Gerardus Hooft, Hagestein (NL)

(73) Assignee: Multifoil B.V., Utrecht (NL)

( * ) Notice: Subject to any disclaimer, the term of this patent is extended or adjusted under 35 U.S.C. 154(b) by 384 days.

(21) Appl. No.: 11/703,110

(22) Filed: Feb. 7, 2007

(65) Prior Publication Data

US 2007/0190281 A1 Aug. 16, 2007

(30) Foreign Application Priority Data

Feb. 9, 2006 (NL) ..... 1 031 112

(51) Int. Cl.
*B32B 9/00* (2006.01)
*B32B 33/00* (2006.01)
*B32B 7/12* (2006.01)

(52) U.S. Cl. ..... 428/40.1; 428/41.9; 428/42.1; 428/343

(58) Field of Classification Search ..... 428/40.1, 428/40.2, 40.9, 42.1, 41.9, 343, 906
See application file for complete search history.

(56) References Cited

U.S. PATENT DOCUMENTS 2,861,006 A * 11/1958 Salditt ..... 428/195.1
5,354,603 A * 10/1994 Errede et al. ..... 442/361
6,228,485 B1 * 5/2001 Leiter ..... 428/343
6,309,745 B1 * 10/2001 Willms et al. ..... 428/354
6,398,830 B1 * 6/2002 Rhodes et al. ..... 55/385.1

FOREIGN PATENT DOCUMENTS

EP 920899 A1 * 6/1999

* cited by examiner

*Primary Examiner* — Patricia Nordmeyer
(74) *Attorney, Agent, or Firm* — Young & Thompson

(57) ABSTRACT

A tape for closing an opening in at least substantially dust-proof but ventilating manner includes an elongate strip of fabric (10) with an open pore structure (11). The strip is provided according to a pattern (13) with a layer which at least substantially completely closes the pores locally and on a rear side with a glue layer in opposite edge parts (12). The glue layer is arranged between the edge parts (12) in accordance with the pattern and at least almost completely closes the pores (11) locally.

15 Claims, 2 Drawing Sheets

TAPE AND METHOD OF A MANUFACTURING THE SAME

FIELD OF THE INVENTION

The present invention relates to a tape for closing an opening in at least substantially dustproof but ventilating manner, comprising an elongate strip of fabric with an open pore structure, which strip is provided according to a pattern with at least one layer which at least substantially completely closes the open pore structure locally and on a rear side is provided with a glue layer in opposite edge parts.

BACKGROUND OF THE INVENTION

Such a tape is known from Netherlands patent 1003851 of applicant, and is applied particularly for closing cavity channels of double-walled plastic plate material in dustproof yet ventilating and water-permeable and water vapour-permeable manner. The tape comprises an elongate strip of fabric in which or on which is arranged a pattern which completely closes the pores locally so as to thus enable the degree of ventilation to be regulated precisely and as required. The pattern can be a pattern of compacted parts which is arranged mechanically in the strip itself under pressure and at increased temperature, or a coating with which the strip is covered according to the desired pattern.

Although a very satisfactory product can hereby be realized which is highly adaptable to the specific wishes of a customer, it does have the drawback that arranging of the pattern always requires an additional process step and thereby increases the cost price of the product.

SUMMARY OF THE INVENTION

The present invention has for its object, among others, to provide a tape of the type stated in the preamble, which can be manufactured without additional process step while retaining the stated advantages.

In order to achieve the stated objective a tape of the type stated in the preamble has the feature according to the invention that the glue layer completely closes the open pore structure locally, that the glue layer is arranged in accordance with the pattern at least between the edge parts on the rear side of the strip, and that the glue layer thus forms the at least one layer which at least almost completely closes the open pore structure locally. The glue layer is thus arranged on the tape in the desired pattern. Along the edges of the tape the glue layer fulfills the function of adhesive with which the tape can be fixed, while the glue layer between the edge parts seals the open pore structure in accordance with the pattern in order to thus precisely adjust the degree of ventilation of the tape to the relevant wishes. No further process step is thus required for this purpose. Although the glue layer will gradually lose adhesive force in this intermediate area, this does not influence the ventilation-controlling function. It is noted here that, where reference is made in the present patent application to a pattern, this must be understood to mean not only an optionally regular pattern with a strict, mathematical repetition of a single pattern element, but also in a very wide sense any non-random, applied degree of covering which at least almost completely closes a certain part of the pores locally and thus reduces the ventilation of the tape as a whole accordingly.

The pattern can be a single pattern but can also consist of multiple parts. In this respect a particular embodiment of the tape according to the invention has the feature that the glue layer comprises a first pattern in a central part of the surface and a second pattern on either side thereof along an edge of the tape, wherein the second pattern is more dense than the first pattern. The compaction of the glue pattern along the edges here enhances the adhesive function primarily sought here with the glue layer in order to enable adhesion of the tape for instance round an edge of the cavity. In a particularly user-friendly embodiment the tape according to the invention has the feature here that the glue layer comprises a self-adhesive glue and is covered with a protective foil.

In a further particular embodiment the tape according to the invention has the feature that the glue layer comprises an anti-algal and/or anti-fungal agent, in particular a copper-containing compound. An algicidal and fingicidal, or at least anti-algal and anti-fungal, agent can thus be provided by the glue layer, which agent counters degeneration of the tape as a result of fungal or algal growth. In particular a copper-containing agent, such as copper powder, copper grains or one or more copper wires processed into or together with the glue layer, can be applied as such.

The invention also relates to a method for manufacturing a tape intended to close a cavity in at least substantially dustproof yet ventilating manner, wherein a fabric with an open pore structure is provided, in accordance with a pattern, with a layer which at least substantially completely closes the open pore structure locally, the method according to the invention being characterized in that the layer comprises a glue layer and is arranged in accordance with the pattern on a rear side of the fabric. A particular embodiment of the method herein has the feature according to the invention that the fabric is printed with the glue layer, in particular by means of a printing technique from a group comprising transfer coating, screen-printing, flexography and digital printing techniques such as drop-on-demand and piezo printing. The glue layer can thus be applied directly to the fabric in the desired pattern, and no further processing steps are required later for this purpose.

In order to now protect the glue layer, a further embodiment of the method has the feature according to the invention that, after being provided with the glue layer, the fabric is covered with a protective foil. A silicone paper, which only forms a semi-permanent adhesion with the glue layer but nevertheless protects the glue layer sufficiently against outside influences, is for instance used for the protective foil. A preferred embodiment of the method has in this respect the feature according to the invention that the glue layer is arranged on the protective foil in accordance with the pattern and is transferred from the protective foil onto the fabric by joining the protective foil and the fabric together under pressure. The glue layer is thus applied to the fabric by means of transfer coating, making use of the protective foil as release paper.

BRIEF DESCRIPTION OF THE DRAWINGS

The invention will now be further elucidated on the basis of an exemplary embodiment and an associated drawing. In the drawing.

The figures are purely schematic and not drawn to scale. Some dimensions in particular are exaggerated to greater or lesser extent for the sake of clarity. Corresponding parts are designated in the figures with the same reference numeral.

DETAILED DESCRIPTION OF THE INVENTION

Figure 1:
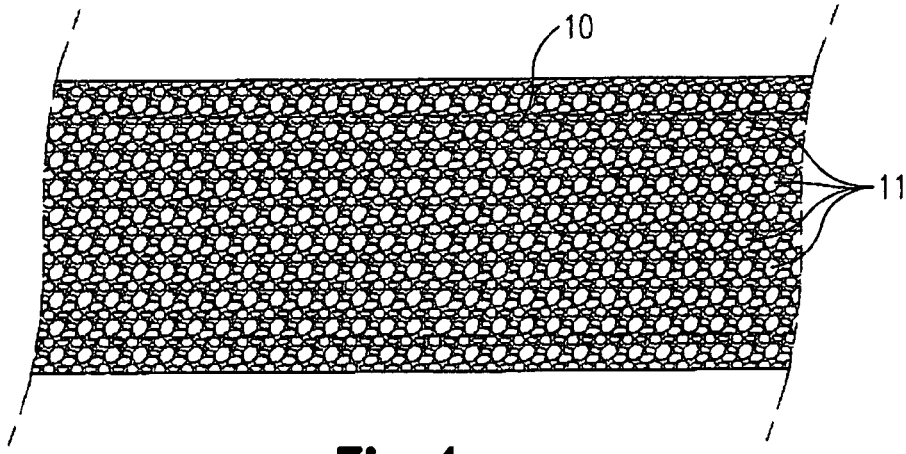
FIG. 1 shows a top view of an embodiment of a tape according to the invention.

FIG. 1 shows a visual side of an exemplary embodiment of a tape according to the invention. The tape comprises an elongate strip of fabric 10, for which use is made in this embodiment of a non-woven polyester fleece. The strip has over a whole surface thereof an optionally regular pore structure of pores 11 which are at least substantially large enough to allow ventilation and transport of water and water vapour, but which are small enough to stop dust particles, micro-organisms and the like. The tape can thus be applied for closing cavities, such as for instance cavity channels of double-walled plate material, in dustproof yet nevertheless ventilating manner. Such plate material is applied on large scale in transparent and translucent form in light corridors and roof coverings, wherein it is important that an inner side of the material also remains spotless.

Figure 2:
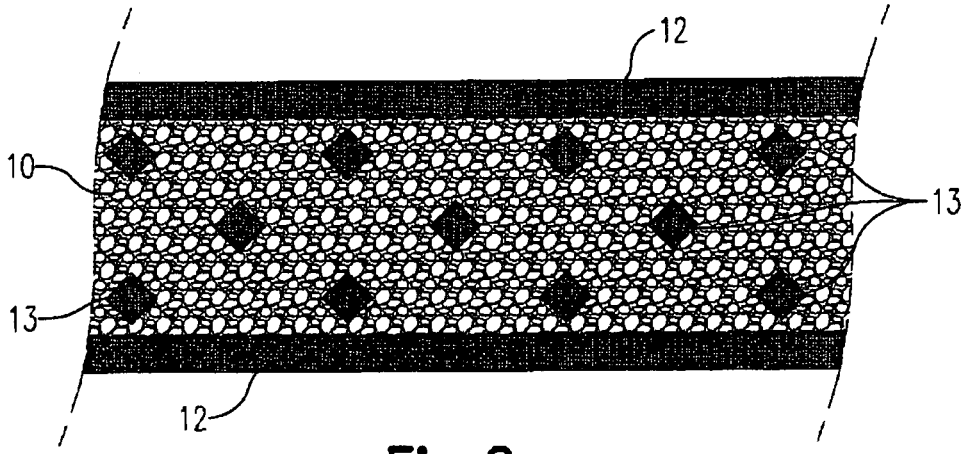
FIG. 2 shows a bottom view of the tape of FIG. 1 in a first manufacturing step.
Figure 3:
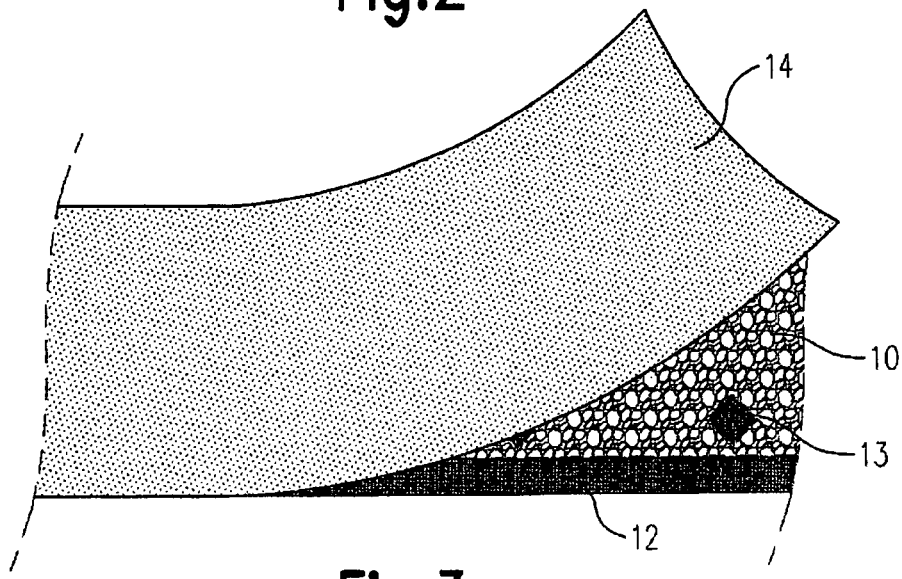
FIG. 3 shows the finished product of FIG. 2.

On a rear side of the tape, see FIG. 2, edge parts 12 are provided with a self-adhesive glue layer so that the tape can be fixed in simple manner. In order to enable precise regulation of the degree of ventilation of tape 10, and therewith the insulating value of double-walled plate material which is closed therewith, and enable adjustment thereof to the wishes of a customer, the glue layer is also applied between edge parts 12 in accordance with a predetermined pattern 13. The glue layer completely closes the pores 11 in strip 10 locally so that ventilation is no longer possible there. The total ventilation capacity of the tape can thus be reduced as desired by adjusting the density of the pattern.

If desired, a fingicidal or anti-fingal and/or algicidal or anti-algal agent can herein also be incorporated into the tape with the glue layer. Use is made as such in this embodiment of a copper-containing agent (not further shown) such as copper powder or copper grains incorporated beforehand in the glue or one or several copper wires arranged simultaneously with the glue layer.

Finally, the tape is provided with a protective foil 14 of silicone paper or the like in order to cover the glue layer until use and protect it against drying out and contamination. In order to manufacture such a tape use is made of a sheet of the desired non-woven material, see FIG. 1, which is cut into strips of a desired strip width of between about 20 and 100 millimetres and onto which the glue layer is printed in one step in a relatively dense pattern in edge parts 12 and the desired ventilation-regulating pattern 13 is printed between the edge parts. Protective foil 14 is then arranged and a strip is processed into a practical roll of a standard length.

Figure 4:
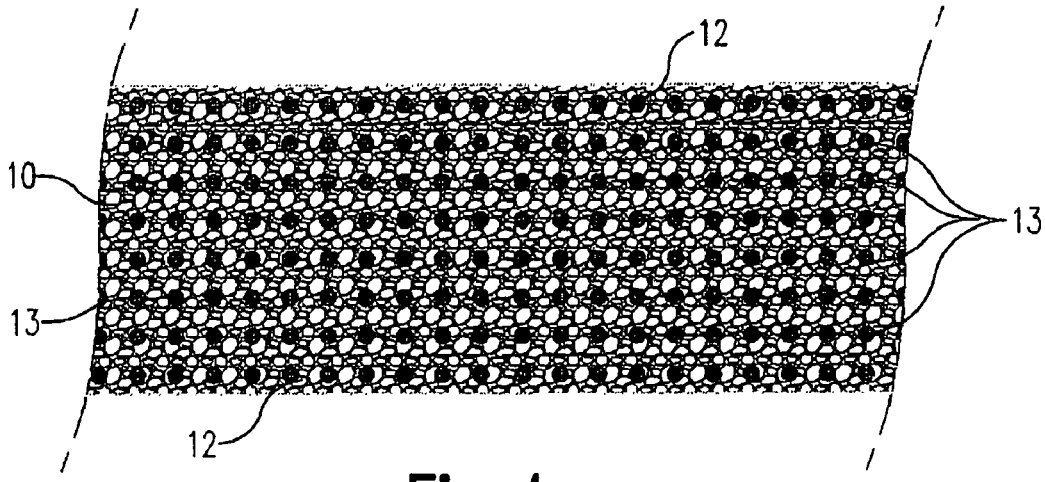
FIG. 4 shows a rear side of a second embodiment of a tape according to the invention.

FIG. 4 shows a rear side of a second embodiment of a tape according to the invention. Apart from the applied glue pattern 13, the tape is the same as that of the first exemplary embodiment. For glue layer 13 use is however not made here of a multiple pattern, as in the first embodiment, but of a single dot pattern 13 of round dots which extends over the whole surface. It is otherwise noted that, if desired, use can also be made of other geometric shapes instead of round dots. In a central part of the tape the dot pattern provides the desired ventilation-regulating action, while sufficient adhesive force is hereby achieved along the edges to enable durable fixing of the tape. Such a uniform glue pattern provides particular advantages from a production engineering viewpoint if the tape is assembled in a relatively large width and only then processed into thinner strips. In that case no account need be taken of a mutual registration of cut edges and edge parts, and any desired strip width can moreover be selected afterward.

Figure 5:
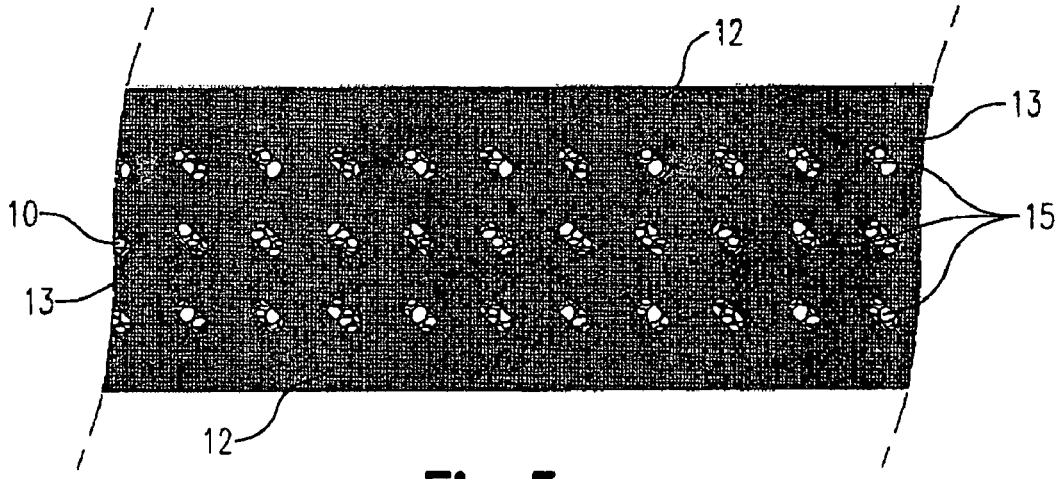
FIG. 5 shows a third exemplary embodiment of a tape according to the present invention with a denser pattern.

In both the foregoing exemplary embodiments the glue pattern has a degree of covering of less than 50% in the central part of the tape, so that a relatively high ventilation of vapour and air through the tape remains possible. It is also possible to opt instead for a more dense pattern, such as that of the third exemplary embodiment of FIG. 5. Glue pattern 13 herein forms a vapour barrier which allows hardly any ventilation and so particularly prevents entry of water vapour via an opening closed therewith. Situated in vapour barrier 13 are relatively small openings 15 which leave clear the underlying tape structure so as to nevertheless impart sufficient drainage capacity to the tape. As in the foregoing examples, the selected pattern is only an example in respect of the shape of openings 15 and the density, and the invention allows precisely the shape and density to be freely adjusted in precise manner to a specific requirement.

Although the invention has been further elucidated on the basis of only this one exemplary embodiment, it will be apparent that the invention is by no means limited thereto. On the contrary, many other variations and embodiments are possible within the scope of the invention. The glue layer patterns of the exemplary embodiments are thus only examples, and other geometric shapes, in addition to higher and lower densities, can be applied within the pattern. Although it can be applied more generally, the tape according to the invention is particularly suitable for closing cavity channels in multi-walled plate material in dustproof but nevertheless water and water vapour-permeable manner.

The invention claimed is:

1. A tape for closing an opening in a substantially dustproof but ventilating manner, comprising:

an elongate strip of fabric with an open pore structure, and a glue layer on substantially an entire surface of the strip of fabric in a predetermined pattern, wherein, the glue layer is applied on a central part of the surface between edge parts of the tape in a first pattern such that the glue layer completely closes the open pore structure at distinct locations on the surface so that ventilation is no longer possible through the tape at the distinct locations, the open pore structure remaining open at other distinct locations and the open pore structure remaining open at other distinct locations such that ventilation is possible through the tape at the other distinct locations, and the glue layer is applied on either side of the central part along the edge parts of the elongate strip of fabric in a second pattern that is more dense than the first pattern.

2. The tape as claimed in claim 1, wherein the glue layer applied on either side of the central part forms a continuous, uninterrupted glue layer along the edge parts of the elongate strip of fabric.

3. The tape as claimed in claim 2, wherein the glue layer comprises a self-adhesive glue and is covered with a protective foil.

4. The tape as claimed in claim 2, wherein the strip of fabric comprises a non-woven fleece.

5. The tape as claimed in claim 2, wherein the glue layer comprises an anti-algal and/or anti-fungal agent.

6. The tape as claimed in claim 1, wherein the glue layer comprises a self-adhesive glue and is covered with a protective foil.

7. The tape as claimed in claim 6, wherein the strip of fabric comprises a non-woven fleece.

8. The tape as claimed in claim 6, wherein the glue layer comprises an anti-algal and/or anti-fungal agent.

9. The tape as claimed in claim 1, wherein the strip of fabric comprises a non-woven fleece.

10. The tape as claimed in claim 9, wherein the non-woven fleece comprises one of polyester, polypropylene, polyethylene or polyurethane.

11. The tape as claimed in claim 1, wherein the glue layer comprises an anti-algal and/or anti-fungal agent.

12. The tape as claimed in claim 11, wherein the anti-algal and/or anti-fungal agent comprises a copper-containing agent.

13. A tape for closing a cavity in a multi-walled cavity plate in a substantially dust-proof but ventilating manner, the tape comprising:

an elongate strip of fabric with an open pore structure which is locally closed by a patterned layer to inhibit ventilation at distinct locations, and an adhesive layer provided across substantially an entire surface of the elongate strip of fabric, the adhesive layer provided in a first pattern on a central part of the surface between edge parts of the tape, and provided in a second pattern on either side of the central part along the edge parts, said second pattern being more dense than the first pattern, to form said patterned layer and which locally closes the open pore structure of the fabric, the multi-walled cavity plate comprising a first wall and a second wall and at least one cavity in between the first wall and the second wall, the tape closing said cavity at a free end of the first wall and second wall, wherein the pattern of said adhesive layer which locally closes the open pore structure of the fabric inhibits ventilation across an opening of the cavity at the distinct locations.

14. A system for closing an opening in a multi-walled cavity plate in a substantially dustproof but ventilating manner, the system comprising:

a tape comprising an elongate fabric strip, the fabric strip having an open pore structure comprised of pores at least substantially large enough to allow ventilation and transport of water and water vapour therethrough and small enough to stop dust particles from passing therethrough and a self-adhesive glue layer on a rear side of the fabric strip, the glue layer extending in a first pattern along edges parts of the rear side of the fabric strip and applied in a second pattern across substantially an entire surface of the rear side within the edges parts, said first pattern being more dense than said second pattern, said glue layer locally completely closing the pores of the fabric strip along the edges parts and at the applied pattern so that the glue layer locally forms a vapour barrier so that the ventilation and the transport of water and water vapour therethrough is prevented, the rear side further comprising areas free of the glue layer, said glue-free area providing a surface allowing the ventilation and stopping dust particles; and a removable protective layer of the tape covering the glue layer, the multi-walled cavity plate comprising a first wall and a second wall and at least one cavity with the opening between the first wall and the second wall, the tape closing the cavity at a free end of the first wall and second wall, wherein the closed pores of the fabric strip locally inhibit ventilation of the opening.

15. A system for closing an opening in a multi-walled cavity plate in a substantially dustproof but ventilating manner, the system comprising:

a tape comprising an elongate fabric strip, the fabric strip having an open pore structure comprised of pores at least substantially large enough to allow ventilation and transport of water and water vapour therethrough and small enough to stop dust particles from passing therethrough, and a self-adhesive glue layer on a rear side of the fabric strip, the glue layer applied to a central part between edge parts of the fabric strip in a first pattern across substantially an entire surface of the rear side and locally completely closing the pores of the fabric strip at the applied pattern so that the glue layer locally forms a vapour barrier so that the ventilation and the transport of water and water vapour therethrough is prevented, the rear side further comprising areas free of the glue layer, said glue-free area providing a surface allowing the ventilation and stopping dust particles, and the glue layer is applied on either side of the central part along the edge parts of the fabric strip in a second pattern that is more dense than the first pattern; and a removable protective layer of the tape covering the glue layer, the multi-walled cavity plate comprising a first wall and a second wall and at least one cavity with the opening between the first wall and the second wall, the tape closing the cavity at a free end of the first wall and second wall, wherein the closed pores of the fabric strip locally inhibit ventilation of the opening.

* * * * *